US010676315B2

(12) United States Patent
Baldi

(10) Patent No.: US 10,676,315 B2
(45) Date of Patent: Jun. 9, 2020

(54) IDENTIFICATION OF A CROWD IN AN ELEVATOR WAITING AREA AND SEAMLESS CALL ELEVATORS

(71) Applicant: OTIS ELEVATOR COMPANY, Farmington, CT (US)

(72) Inventor: Emily Baldi, East Hartford, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 363 days.

(21) Appl. No.: 15/646,707

(22) Filed: Jul. 11, 2017

(65) Prior Publication Data

US 2019/0016557 A1 Jan. 17, 2019

(51) Int. Cl.

| | |
|---|---|
| ***B66B 1/24*** | (2006.01) |
| ***B66B 1/28*** | (2006.01) |
| ***B66B 1/34*** | (2006.01) |
| ***B66B 5/00*** | (2006.01) |
| ***B66B 9/00*** | (2006.01) |

(52) U.S. Cl.

CPC ..... *B66B 1/2408* (2013.01); *B66B 1/2458* (2013.01); *B66B 1/28* (2013.01); *B66B 1/3476* (2013.01); *B66B 5/0012* (2013.01); *B66B 9/00* (2013.01); *B66B 2201/215* (2013.01); *B66B 2201/222* (2013.01)

(58) Field of Classification Search

CPC ..... B66B 1/2408; B66B 1/28; B66B 1/3476
USPC ..... 187/247
See application file for complete search history.

(56) References Cited

U.S. PATENT DOCUMENTS

| | | | | |
|---|---|---|---|---|
| 4,838,384 | A * | 6/1989 | Thangavelu | B66B 1/2458 187/385 |
| 5,258,586 | A | 11/1993 | Suzuki et al. | |
| 5,387,768 | A | 2/1995 | Izard et al. | |
| 5,511,635 | A * | 4/1996 | Kameli | B66B 1/2408 187/383 |
| 6,209,685 | B1 | 4/2001 | Zaharia et al. | |
| 6,257,373 | B1 | 7/2001 | Hikita et al. | |
| 6,397,976 | B1 | 6/2002 | Hale et al. | |

(Continued)

FOREIGN PATENT DOCUMENTS

| | | |
|---|---|---|
| CN | 1795132 A | 6/2006 |
| CN | 103010874 A | 4/2013 |

(Continued)

OTHER PUBLICATIONS

European Search Report for application EP 18182763, dated Dec. 7, 2018, 6 pages.

(Continued)

*Primary Examiner* — David S Warren
(74) *Attorney, Agent, or Firm* — Cantor Colburn LLP

(57) ABSTRACT

An elevator system is provided and includes at least one car; driving elements, each of the driving elements being configured to drive a corresponding car from a waiting area from which at least one passenger boards the corresponding car; at least one sensor configured to identify a presence of more than one passenger intending to board a car and in the waiting area and configured to determine a characteristic of the more than one passenger; and a controller configured to drive more than one car to the waiting area when a capacity of the corresponding car is less than the characteristic of the more than one passenger.

20 Claims, 3 Drawing Sheets

(56) References Cited

U.S. PATENT DOCUMENTS

| | | | | |
|---|---|---|---|---|
| 7,140,469 | B2 | 11/2006 | Deplazes et al. | |
| 7,712,586 | B2 * | 5/2010 | Legez | B66B 1/20 187/387 |
| 8,020,672 | B2 * | 9/2011 | Lin | B66B 1/34 187/316 |
| 8,573,366 | B2 | 11/2013 | Elomaa et al. | |
| 8,615,338 | B2 * | 12/2013 | Creissels | B61B 12/022 701/19 |
| 8,960,373 | B2 * | 2/2015 | De Vincentis | B66B 1/2408 187/381 |
| 9,079,751 | B2 * | 7/2015 | Sundholm | B66B 1/2458 |
| 9,481,548 | B2 | 11/2016 | Siddiqui et al. | |
| 9,731,934 | B2 * | 8/2017 | Stanley | B66B 1/468 |
| 9,873,590 | B2 * | 1/2018 | Salmikuukka | B66B 3/006 |
| 10,131,518 | B2 * | 11/2018 | Vuorenala | B66B 3/006 |
| 10,207,893 | B2 * | 2/2019 | Elomaa | B66B 1/2458 |
| 10,239,728 | B2 * | 3/2019 | Finn | B66B 1/3476 |
| 10,370,220 | B2 * | 8/2019 | Simcik | B66B 1/3476 |
| 2006/0037818 | A1 * | 2/2006 | Deplazes | B66B 1/3476 187/392 |
| 2007/0272493 | A1 * | 11/2007 | Legez | B66B 1/20 187/313 |
| 2009/0057068 | A1 * | 3/2009 | Lin | B66B 1/34 187/392 |
| 2015/0329316 | A1 | 11/2015 | Lee | |
| 2016/0083218 | A1 | 3/2016 | Vuorenala et al. | |
| 2016/0289042 | A1 | 10/2016 | Fang et al. | |

FOREIGN PATENT DOCUMENTS

| | | | |
|---|---|---|---|
| JP | 2006151533 | A | 6/2006 |
| JP | 6092498 | A | 3/2017 |

OTHER PUBLICATIONS

Gleick, James, "Clevers Elevators 'Learn' From Experience", New York Times, Apr. 28, 1987, 5 pages.

Chinese Office Action for application 201810754062.X, dated Apr. 2, 2020, 49 pages.

* cited by examiner

IDENTIFICATION OF A CROWD IN AN ELEVATOR WAITING AREA AND SEAMLESS CALL ELEVATORS

BACKGROUND

The following description relates to elevator systems and, more specifically, to using sensors to identify crowds in an elevator waiting area and seamless call elevators.

A passenger movement device may be provided as an elevator. The passenger movement device permits a passenger to board the passenger movement device, to ride the passenger movement device from a location where boarding occurred and to dismount the passenger movement device at a dismounting location. In the case of the passenger movement device being an elevator, the boarding and dismounting locations may be any floor of a building that the elevator services.

In any case, in elevator systems, an elevator group serves a floor call with any combination of active or idle cars depending on dispatching parameters supported for traffic modes in that building.

BRIEF DESCRIPTION

According to an aspect of the disclosure, an elevator system is provided and includes at least one car; driving elements, each of the driving elements being configured to drive a corresponding car from a waiting area from which at least one passenger boards the corresponding car; at least one sensor configured to identify a presence of more than one passenger intending to board a car and in the waiting area and configured to determine a characteristic of the more than one passenger; and a controller configured to drive more than one car to the waiting area when a capacity of the corresponding car is less than the characteristic of the more than one passenger.

In accordance with additional or alternative embodiments, the at least one sensor includes at least one of a piezoelectric sensor, a video recording or transmission device, a sound sensor, an infrared sensor, a temperature sensor, a motion sensor, and a vibration sensor.

In accordance with additional or alternative embodiments, at least one of weight or pressure analysis, video analysis, sound analysis, infrared analysis, temperature analysis, motion analysis, and vibration analysis identifies travel intent of the more than one passenger.

In accordance with additional or alternative embodiments, the characteristic includes weight.

In accordance with additional or alternative embodiments, the characteristic includes quantity.

In accordance with additional or alternative embodiments, the characteristic includes size.

In accordance with additional or alternative embodiments, the characteristic includes the characteristic of one or more objects on or with the more than one passenger.

According to another aspect of the disclosure, a method of operating an elevator system including a plurality of cars is provided and includes identifying a presence of more than one passenger intending to board one of the cars and in a waiting area, determining a characteristic of the more than one passenger of the more than one passenger, determining a capacity of a car servicing the waiting area, comparing the capacity of the car servicing the waiting area to the characteristic of the more than one passenger, and driving at least one additional car to the waiting area when the capacity of the car servicing the waiting area is less than the characteristic of the more than one passenger.

In accordance with additional or alternative embodiments, identifying the presence of the more than one passenger includes at least one of weight or pressure analysis, video analysis, sound analysis, infrared analysis, temperature analysis, motion analysis, and vibration analysis.

In accordance with additional or alternative embodiments, the at least one of weight or pressure analysis, video analysis, sound analysis, infrared analysis, temperature analysis, motion analysis, and vibration analysis further identifies travel intent of the more than one passenger.

In accordance with additional or alternative embodiments, comparing the capacity of the car servicing the waiting area to the characteristic of the more than one passenger is performed when the car is servicing the waiting area or prior to a call button of the elevator system having been pressed.

In accordance with additional or alternative embodiments, driving the at least one additional car to the waiting area is performed when a door of the car servicing the waiting area is open.

In accordance with additional or alternative embodiments, driving the at least one additional car to the waiting area includes driving more than one car to the waiting area.

In accordance with additional or alternative embodiments, the method further includes calculating a summed capacity of more than one car in the elevator system, comparing the summed capacity to the characteristic of the more than one passenger, and driving at least one additional car to the waiting area when the summed capacity is less than the characteristic of the more than one passenger.

In accordance with additional or alternative embodiments, determining the capacity of the car servicing the waiting area includes subtracting the characteristic of one or more passengers already in the car from a maximum capacity of the car servicing the waiting area.

In accordance with additional or alternative embodiments, determining the capacity of the car servicing the waiting area includes retrieving a stored maximum capacity of the car servicing the waiting area.

In accordance with additional or alternative embodiments, the characteristic includes weight.

In accordance with additional or alternative embodiments, the characteristic includes quantity.

In accordance with additional or alternative embodiments, the characteristic includes size.

In accordance with additional or alternative embodiments, the characteristic includes the characteristic of one or more objects on or with the more than one passenger.

These and other advantages and features will become more apparent from the following description taken in conjunction with the drawings.

BRIEF DESCRIPTION OF THE DRAWINGS

The subject matter, which is regarded as the disclosure, is particularly pointed out and distinctly claimed in the claims at the conclusion of the specification. The foregoing and other features, and advantages of the disclosure are apparent from the following detailed description taken in conjunction with the accompanying drawings in which:

These and other advantages and features will become more apparent from the following description taken in conjunction with the drawings.

DETAILED DESCRIPTION

As will be described below, sensors are used to determine demand present in an elevator waiting area when a car is servicing the waiting area. If the observed demand exceeds a capacity of the car servicing the waiting area, additional cars are assigned to meet the demand. If a door of the car servicing the waiting area is open or the car servicing the waiting area is otherwise in an extended service state, other passengers may call another car without interrupting service to the car servicing the waiting area. If demand exists in the waiting area and the call button has not yet been pressed, the system may proactively assign cars to serve the waiting area.

By assigning at least one additional car matching real-time demand in waiting areas during peak times, waiting areas will clear more efficiently, making passengers happier with wait times and building owners more satisfied with elevator operation. Additionally, passenger frustration will be reduced by avoiding the situation in which a car servicing the waiting area or a car departing the waiting area is reassigned to the waiting area when remaining passengers push the call button. The at least one sensor in place for sensing demand also enables seamless elevator calls.

Figure 1:
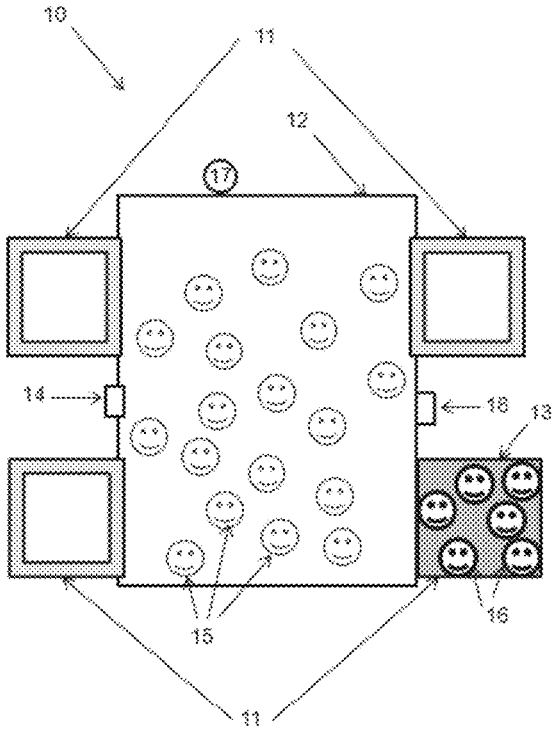
FIG. 1 is top view of an elevator system in accordance with embodiments.

With reference to FIG. 1, an elevator system 10 includes multiple hoistways 11, e.g., shafts that each encompass an elevator car, a sensing area 12, which may correspond to a waiting area from which passengers may board an elevator car 13, and at least one call button 14. Passengers 15 standing or sitting in the sensing area, as opposed to one or more passengers 16 in the elevator car 13, may not be able to board the elevator car 13 if a characteristic of such passengers 15 is greater than a capacity of the elevator car 13.

The characteristic may be, for example, at least one of weight, number or quantity, and size. The characteristic may include the characteristic of one or more objects (i.e., wheelchair, pet, luggage, trolley, cargo, suitcase, etc.) on or with the passengers 15 intending to board the elevator car 13.

In embodiments, the characteristic of passengers 15 intending to board an elevator car 13 can be a total weight of the passengers 15 (inclusive of one or more optional objects on or with the passengers 15), and a weight capacity of the elevator car 13 can be determined to be compared to the total weight of the passengers 15 (inclusive of the one or more optional objects on or with the passengers 15). In embodiments, the characteristic of passengers 15 intending to board an elevator car 13 can be a number or quantity of the passengers 15 or a size of a crowd of the passengers 15 (inclusive of one or more optional objects on or with the passengers 15), and a volume capacity of the elevator car 13 can be determined to be compared to the number or quantity of the passengers 15 or a size of a crowd of the passengers 15 (inclusive of the one or more optional objects on or with the passengers 15).

The sensing area 12 identifies a presence of more than one passenger 15 intending to board one of the elevators of the elevator system 10 and standing or sitting in a waiting area from which at least one passenger 16 boards the elevator car 13 and determines a characteristic of the more than one passenger 15 intending to board one of the elevators and standing or sitting in the waiting area. The sensing area 12 includes at least one sensor 17. Such sensors may include, for example, at least one of a piezoelectric sensor, a video recording or transmission device, a sound sensor, an infrared sensor, a temperature sensor, a motion sensor, a depth sensor, a vibration sensor, or any other known and/or desired sensor. The sensor may identify, for example, at least one of the presence, quantity, and travel intent, of passengers standing or sitting in the waiting area by using at least one of weight or pressure analysis, video analysis, sound analysis, infrared analysis, temperature analysis, motion analysis, vibration analysis, vocal inflection analysis, behavior modeling, or any other known and/or desired analytical technique.

In embodiments, the floor of the sensing area may be equipped with sensors, for example, piezoelectric sensors, that generate electrical signals based on the pressure and/or and force applied to them. The sensors may be calibrated or nulled for the weight of the sensing area and any pre-load resulting therefrom. The electrical signal produced by each of the sensors may be amplified and made linear by a first stage amplifier and fed to a summing amplifier which sums the values for all of the sensors to produce a composite signal proportional to the summed signals of all the sensors.

The sensors that generate electrical signals based on the pressure and/or and force applied to them may sense at least one of weight, number or quantity, or volume. In embodiments, the value for each of the sensors may include a calculated weight based on the pressure and/or and force. In embodiments, the value for each of the sensors may include a positive value when a pressure and/or and force is applied to the sensor, and the composite signal proportional to the summed signals of all the sensors would provide a total number of sensors to which a pressure and/or and force is applied. Accordingly, a weight, number or quantity, or volume of passengers intending to board one of the elevators and in the waiting area can be determined. As described above, the weight, number or quantity, or volume of the passengers may include one or more objects on or with the passengers.

The determined weight, number or quantity, or volume of passengers intending to board one of the elevators and in the waiting area is compared to a capacity of the elevator. An indication can be provided to the waiting area when the capacity of the elevator is less than the determined weight, number or quantity, or volume of the passengers intending to board one of the elevators. At least one additional elevator is driven to the waiting area when the capacity of the elevator is less than the determined weight, number or quantity, or volume of the passengers intending to board one of the elevators.

In embodiments, digital processing functions may be used for crowd size estimation from a live video signal. One processing function is motion detection based on, for example, at least one of optical-flow and frame difference with steerable filters. At least one motion sensors may be used to measure overall intensity of physical motion in a given space. In one embodiment, the overall intensity of physical motion in a given space may be measured using any single or combination of the sensors. Another processing function is background modeling to segment foreground objects with shadow suppression capability. The crowd may be segmented by adaptive background subtraction with shadow suppression.

A crowd size or number of passengers can be calculated by comparing, for example, a measured amount of motion to known reference values that are indicative of a given crowd size or number of passengers. Accordingly, a crowd size or number of passengers intending to board one of the elevators and in the waiting area can be determined. As described above, the crowd size or number of the passengers may include one or more objects on or with the passengers.

The determined crowd size or number of passengers intending to board one of the elevators and in the waiting area is compared to a capacity of the elevator. An indication can be provided to the waiting area when the capacity of the elevator is less than the determined crowd size or number of passengers intending to board one of the elevators. At least one additional elevator is driven to the waiting area when the capacity of the elevator is less than the determined crowd size or number of passengers intending to board one of the elevators.

In embodiments, real-time crowd signals that may be used for crowd size estimation include a sound, signal. At least one of sound pressure level and sound level meters may be used. In embodiments, the sound pressure level meter is a self-ranging decibel meter, i.e., one that can adjust decibel range based on actual sound pressure ranges. In embodiments, other sound, noise or decibel level meters may be employed. In embodiments, microphones may be used to record an audio signal, including signal intensity, and evaluate sound profile in the recording.

A crowd size or number of passengers can be calculated by comparing, for example, a measured decibel level to known reference values that are indicative of a given crowd size or number of passengers. Accordingly, a crowd size or number of passengers intending to board one of the elevators and in the waiting area can be determined. As described above, the crowd size or number of the passengers may include one or more objects on or with the passengers.

The determined crowd size or number of passengers intending to board one of the elevators and in the waiting area is compared to a capacity of the elevator. An indication can be provided to the waiting area when the capacity of the elevator is less than the determined crowd size or number of passengers intending to board one of the elevators. At least one additional elevator is driven to the waiting area when the capacity of the elevator is less than the determined crowd size or number of passengers intending to board one of the elevators.

Signals in addition to sound- or noise-based ones may also be employed as an alternative to, or in combination with, those that are sound-based. In embodiments, vibration sensors may also be used to similar effect, e.g., as the level of physical activity in a space increased, the vibration signal would increase. Also possible are temperature sensors and/or infrared signal meters. As the number of passengers in a given space increases, the temperature or infrared heat signal would increase.

A crowd size or number of passengers can be calculated by comparing, for example, a measured vibration level, or temperature to known reference values that are indicative of a given crowd size or number of passengers. Accordingly, a crowd size or number of passengers intending to board one of the elevators and in the waiting area can be determined. As described above, the crowd size or number of the passengers may include one or more objects on or with the passengers.

The determined crowd size or number of passengers intending to board one of the elevators and in the waiting area is compared to a capacity of the elevator. An indication can be provided to the waiting area when the capacity of the elevator is less than the determined crowd size or number of passengers intending to board one of the elevators. At least one additional elevator is driven to the waiting area when the capacity of the elevator is less than the determined crowd size or number of passengers intending to board one of the elevators.

In embodiments, cellphone signal detection may be used. A single or multi-modal cellphone signal detector, e.g., 3G, voice, WiFi, or Bluetooth®, may detect outbound signals. As the number of passengers intending to board an elevator and standing or sitting in the sensing area increases, the number of overall cellphone signals would increase.

A number of passengers can be correlated to a number of cellphone signals. The perceived number of passengers intending to board one of the elevators and in the waiting area is compared to a capacity of the elevator. An indication can be provided to the waiting area when the capacity of the elevator is less than the determined number of passengers intending to board one of the elevators. At least one additional elevator is driven to the waiting area when the capacity of the elevator is less than the determined number of passengers intending to board one of the elevators.

With the provision of sensors as described above, the identification of a given passenger's intent to board an elevator may be derived from various characteristics of that passenger that are sensed by one or more of the sensors. For example, if one or more motion sensors observe that a passenger is standing still in the waiting area and not moving on, such behavior may be interpreted as evidence of an intent to board an elevator. However, if the one or more motion sensors observe that a passenger is standing still in the waiting area and not moving after arrival of an elevator to service the waiting area, such behavior may be interpreted as evidence of an intent not to board the elevator.

As another example, if one or more motion sensors observe that a passenger enters the waiting area with a group of passengers and one of those passengers enters an elevator call but the passenger does not, such behavior may be interpreted as evidence of the intent to board the elevator despite his lack of explicit call entering. Further, if cellphone signal detection detects an outbound signal immediately after arrival of an elevator to service the waiting area, one or more cellphone signal, such behavior may be interpreted as evidence of an intent not to board the elevator, as the passenger who initiated the cellphone call may expect the cellphone signal to be lost upon boarding the elevator.

A maximum capacity of each elevator car 13 in the elevator system 10 is stored. For example, a maximum weight capacity or maximum volume capacity of the elevator car 13 can be stored. In embodiments, a capacity of an elevator car 13 can be determined by retrieving a stored maximum capacity of the elevator car 13. In embodiments, a capacity of an elevator car 13 can be determined by subtracting the characteristic of one or more passengers 16 already in the elevator car 13 from a maximum capacity of the elevator car 13.

Figure 2:
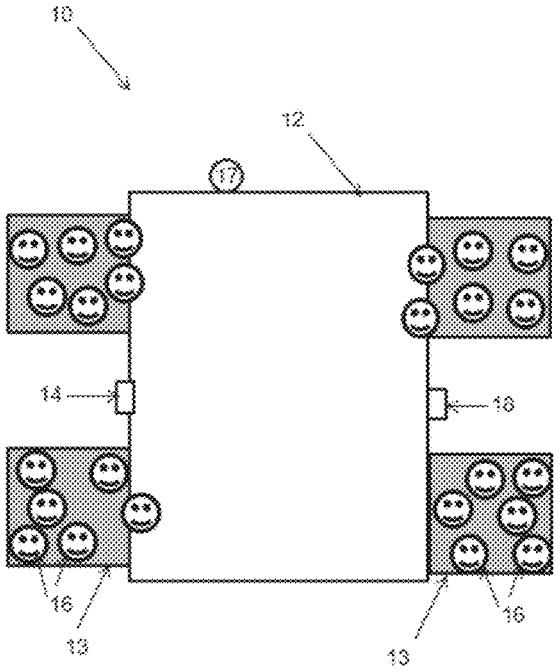
FIG. 2 is top view of an elevator system in accordance with embodiments.

When the number of passengers 15 standing or sitting in the sensing area 12 is greater than the capacity of an elevator car 13, at least one additional elevator is driven to the sensing area 12 to minimize or eliminate passengers standing or sitting in the sensing area 12, as depicted in FIG. 2. In embodiments, as depicted in FIG. 2, three additional elevator cars 13 are driven to the sensing area 12 to eliminate passengers standing or sitting in the sensing area 12.

Figure 3:
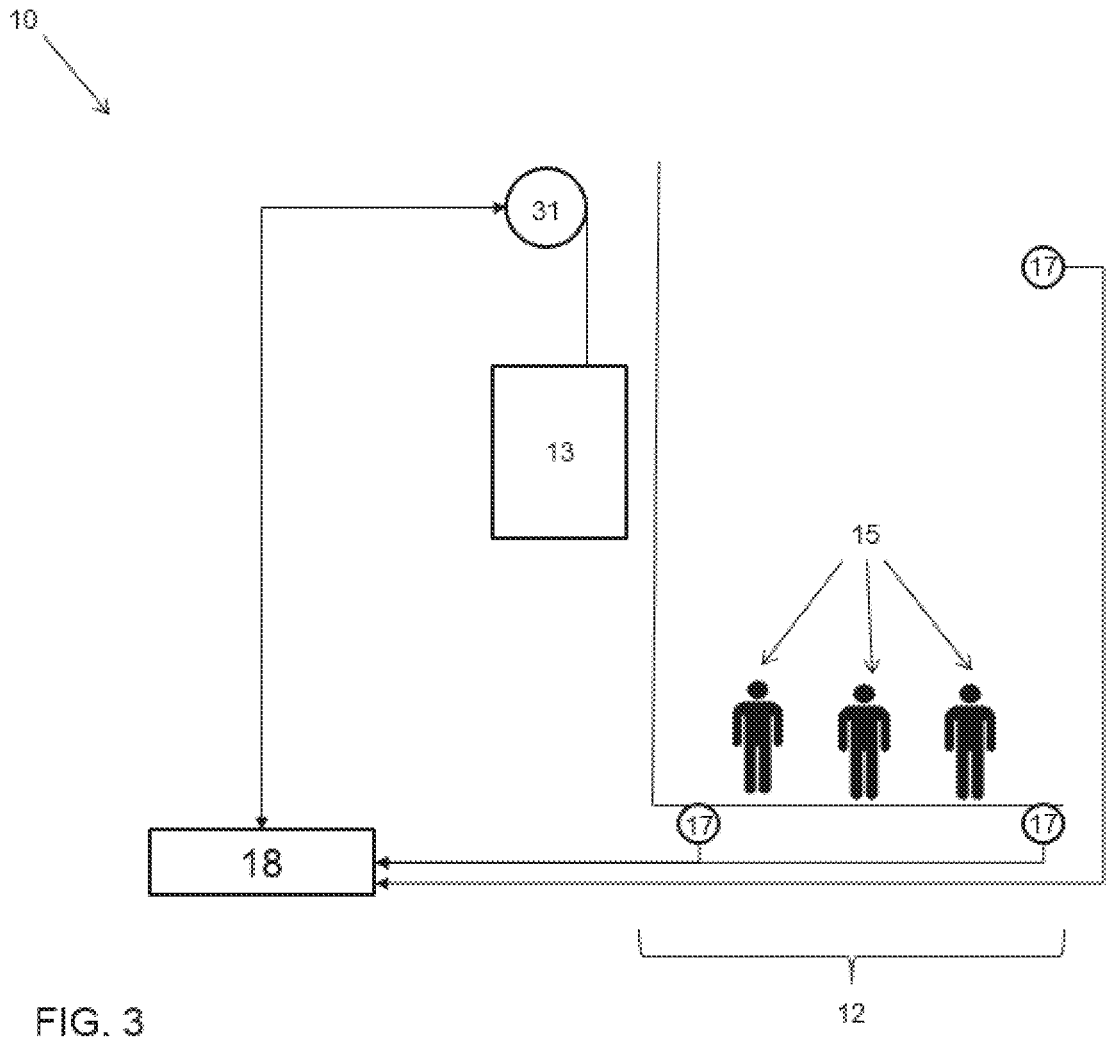
FIG. 3 is a system diagram of an elevator system in accordance with embodiments.

At least one additional elevator may be driven to the sensing area 12 automatically or proactively when the elevator system 10 determines that the capacity of an elevator car 13 is less than the number of passengers 15 standing or sitting in the waiting area. As further depicted in FIG. 3, the elevator system 10 includes driving element 31, which may be provided as a hoistway machine and configured to drive an elevator car 13 from a boarding location, level or floor at which one or more passengers 15 board the elevator car 13 to a dismounting location, level or floor at which the passenger dismounts from the elevator car 13. One or more sensors 17 are provided in the sensing area 12. A controller 18 may be provided as a computing device that is coupled to the elevator system 10 and/or each of the elevators, and more specifically, to the driving element 31 and/or one or more of the sensors 17. In one embodiment, the controller 18 may be a stand-alone device or remote from the elevator installation.

Comparison of the capacity of an elevator car 13 to the number of passengers 15 standing or sitting in the sensing area 12 may be performed when the elevator car 13 is servicing the waiting area. In one embodiment, comparison of the capacity of an elevator car 13 to the number of passengers 15 standing or sitting in the sensing area 12 may be performed prior to a call button 14 having been pressed. In one embodiment, comparison of the capacity of an elevator car 13 to the estimated number of passengers 15 standing or sitting in the sensing area 12 may be performed continuously or at any desired time. Driving at least one additional elevator to the waiting area may be performed prior to the call button 14 having been pressed. In one embodiment, driving at least one additional elevator to the waiting area may be performed after the call button 14 is been pressed. In one embodiment, driving at least one additional elevator to the waiting area may be performed at any desired time. Driving at least one additional elevator to the waiting area may be performed when a door of the elevator car 13 servicing the waiting area is open. Driving at least one additional elevator to the waiting area may include driving more than one elevator to the waiting area. As depicted in FIG. 2, three additional elevator cars 13 are driven to the sensing area 12.

In embodiments, a summed capacity of more than one elevator in the elevator system may be calculated. The summed capacity may be compared to the characteristic of the more than one passenger intending to board one of the elevators and standing or sitting in the waiting area and at least one additional elevator may be driven to the waiting area when the summed capacity is less than the characteristic of the more than one passenger intending to board one of the elevators and standing or sitting in the waiting area.

In embodiments, an indication may be provided to the waiting area when the capacity of the elevator servicing the waiting area is less than the characteristic of the more than one passenger intending to board one of the elevators and standing or sitting in the waiting area. The indication may be displayed in the waiting area on a display device, e.g., at least one of a liquid crystal display, an organic light emitting diode display, and an elevator floor indicator. The indication may include an audio indication.

The indication may include lighting a call light when the elevator is servicing the waiting area. The call light may have been turned off when the elevator servicing the waiting area arrived. The call light may be lit even when a door of the elevator servicing the waiting area is open. The call light may be lit after a passenger intending to board an elevator and standing or sitting in the waiting area requests an additional elevator. The call light may be lit automatically when the elevator system determines that the capacity of the elevator servicing the waiting area is less than the characteristic of the more than one passenger intending to board one of the elevators and standing or sitting in the waiting area.

Figure 4:
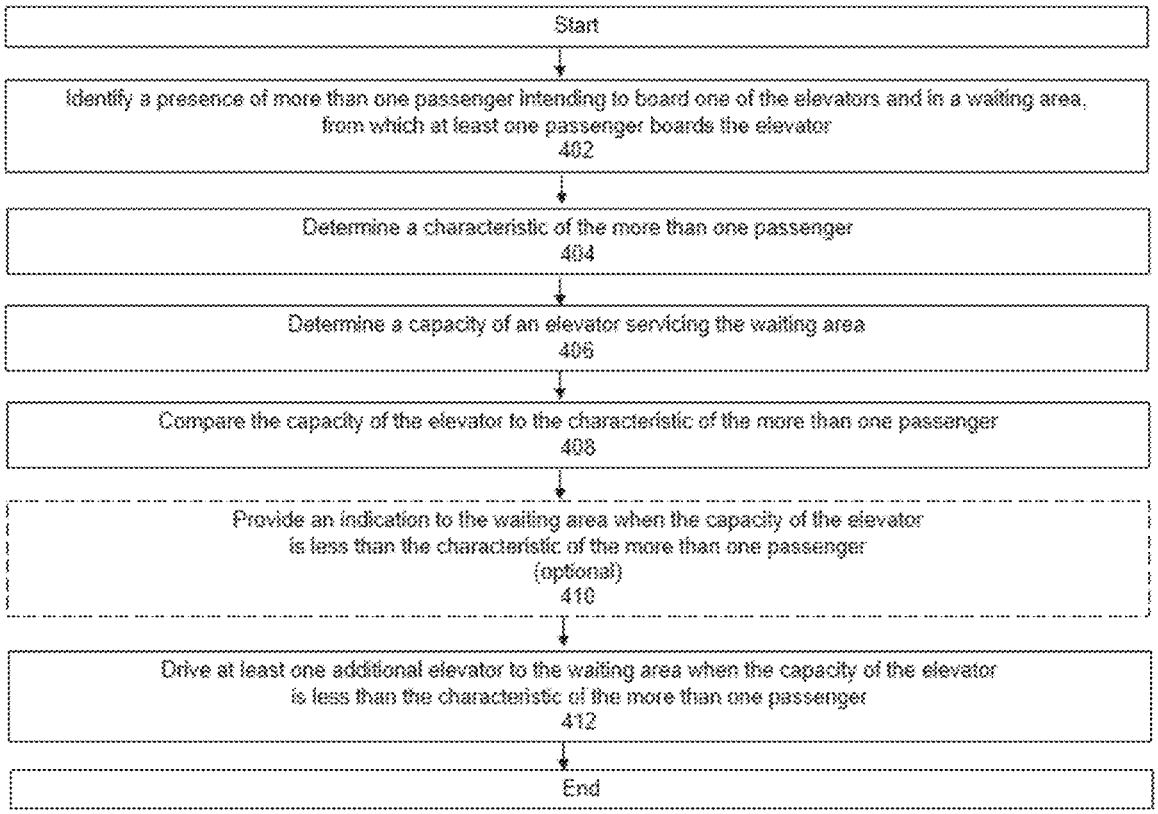
FIG. 4 is a flow diagram illustrating a methodology in accordance with embodiments.

FIG. 4 depicts a block/flow diagram of an exemplary method for operating an elevator system including a plurality of elevators in accordance with embodiments. At block 402, a presence of more than one passenger intending to board one of the elevators and in a waiting area, from which at least one passenger boards the elevator, is identified. At block 404, a characteristic of the more than one passenger is determined. At block 406, a capacity of an elevator servicing the waiting area is determined. At block 408, the capacity of the elevator and the characteristic of the more than one passenger are compared. At optional block 410, an indication is provided to the waiting area when the capacity of the elevator is less than the characteristic of the more than one passenger. At block 412, at least one additional elevator is driven to the waiting area when the capacity of the elevator is less than the characteristic of the more than one passenger.

While the disclosure is provided in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that the exemplary embodiment(s) may include only some of the described exemplary aspects. Accordingly, the disclosure is not to be seen as limited by the foregoing description, but is only limited by the scope of the appended claims.

What is claimed is:

1. An elevator system, comprising:

at least one car;

driving elements, each of the driving elements being configured to drive a corresponding car from a waiting area from which at least one passenger boards the corresponding car;

at least one sensor configured to identify a presence of more than one passenger intending to board a car and in the waiting area and configured to determine a characteristic of the more than one passenger intending to board the car; and a controller configured to drive more than one car to the waiting area when a capacity of the corresponding car is less than the characteristic of the more than one passenger;

wherein the controller is configured to compare the capacity of the corresponding car to the characteristic of the more than one passenger when the corresponding car is servicing the waiting area.

2. The elevator system according to claim 1, wherein the at least one sensor comprises at least one of a piezoelectric sensor, a video recording or transmission device, a sound sensor, an infrared sensor, a temperature sensor, a motion sensor, and a vibration sensor.

3. The elevator system according to claim 2, wherein at least one of weight or pressure analysis, video analysis, sound analysis, infrared analysis, temperature analysis, motion analysis, and vibration analysis identifies travel intent of the more than one passenger.

4. The elevator system according to claim 1, wherein the characteristic includes weight.

5. The elevator system according to claim 1, wherein the characteristic includes quantity.

6. The elevator system according to claim 1, wherein the characteristic includes size.

7. The elevator system according to claim 1, wherein the characteristic includes the characteristic of one or more objects on or with the more than one passenger.

8. A method of operating an elevator system comprising a plurality of cars, the method comprising:

identifying a presence of more than one passenger intending to board one of the cars and in a waiting area;

determining a characteristic of the more than one passenger;

determining a capacity of a car servicing the waiting area;

comparing the capacity of the car servicing the waiting area to the characteristic of the more than one passenger;

driving at least one additional car to the waiting area when the capacity of the car servicing the waiting area is less than the characteristic of the more than one passenger;

calculating a summed capacity of more than one car in the elevator system;

comparing the summed capacity to the characteristic of the more than one passenger; and driving at least one additional car to the waiting area when the summed capacity is less than the characteristic of the more than one passenger.

9. The method according to claim 8, wherein identifying the presence of the more than one passenger comprises at least one of weight or pressure analysis, video analysis, sound analysis, infrared analysis, temperature analysis, motion analysis, and vibration analysis.

10. The method according to claim 9, wherein the at least one of weight or pressure analysis, video analysis, sound analysis, infrared analysis, temperature analysis, motion analysis, and vibration analysis further identifies travel intent of the more than one passenger.

11. The method according to claim 8, wherein comparing the capacity of the car servicing the waiting area to the characteristic of the more than one passenger is performed when the car is servicing the waiting area or prior to a call button of the elevator system having been pressed.

12. The method according to claim 8, wherein driving the at least one additional car to the waiting area is performed when a door of the car servicing the waiting area is open.

13. The method according to claim 8, wherein driving the at least one additional car to the waiting area comprises driving more than one car to the waiting area.

14. The method according to claim 8, wherein determining the capacity of the car servicing the waiting area comprises subtracting the characteristic of one or more passengers already in the car from a maximum capacity of the car servicing the waiting area.

15. The method according to claim 8, wherein determining the capacity of the car servicing the waiting area comprises retrieving a stored maximum capacity of the car servicing the waiting area.

16. The method according to claim 8, wherein the characteristic includes weight.

17. The method according to claim 8, wherein the characteristic includes quantity.

18. The method according to claim 8, wherein the characteristic includes size.

19. The method according to claim 8, wherein the characteristic includes the characteristic of one or more objects on or with the more than one passenger.

20. The elevator system according to claim 1, wherein the at least one sensor is configured to identify the presence of more than one passenger intending to board the car and standing or sitting in the waiting area.

* * * * *